US005178560A

United States Patent [19]

Yaegashi et al.

[11] Patent Number: 5,178,560

[45] Date of Patent: Jan. 12, 1993

[54] CONNECTOR FOR COAXIAL RIBBON CABLE

[75] Inventors: Hirokatsu Yaegashi; Tadahiro Fumikura, both of Tokyo, Japan

[73] Assignee: Hirose Electric Co., Ltd., Tokyo, Japan

[21] Appl. No.: 723,249

[22] Filed: Jun. 28, 1991

[30] Foreign Application Priority Data

Jul. 4, 1990 [JP] Japan ..... 2-175394

[51] Int. Cl.[5] ..... H01R 13/00

[52] U.S. Cl. ..... 439/497

[58] Field of Search ..... 439/394, 492–499, 439/578–585, 607–610

[56] References Cited

U.S. PATENT DOCUMENTS

| | | | |
|---|---|---|---|
| 4,094,564 | 6/1978 | Cacolici | 439/497 |
| 4,094,566 | 6/1978 | Dola et al. | 439/497 |
| 4,352,531 | 10/1982 | Gutter | 439/497 |
| 4,605,276 | 8/1986 | Hasircogulu | 439/497 |
| 4,655,515 | 4/1987 | Hamsher et al. | 439/497 |

*Primary Examiner*—Joseph H. McGlynn

*Attorney, Agent, or Firm*—Kanesaka & Takeuchi

[57] ABSTRACT

A connector (1) for coaxial ribbon cable (11) consists of a male connector (2) and a female connector (3). The male connector includes an insulation case (4) with a partition wall (4*a*); a plurality of signal terminals (8) mounted on one side of the partition wall of the insulation case for connection with a plurality of signal lines (17) of a coaxial cable; and a plurality of ground terminals (9) mounted on the other side of the partition wall for connection with a plurality of drain lines (14) of the coaxial cable to form microstrip lines together with the signal terminals. The female connector includes a second insulation case (33) with a second partition wall (37*a*); a plurality of second signal terminals (43) mounted on one side of the second partition wall for contact with the first signal terminals; and a plurality of second ground terminals (44) for contact with the second ground terminals mounted on the other side of the second partition wall and form second microstrip lines together with the second signal terminals. The first and second microstrip lines are made substantially equal, and each of the terminals has a spring portion.

3 Claims, 11 Drawing Sheets

CONNECTOR FOR COAXIAL RIBBON CABLE

BACKGROUND OF THE INVENTION

1. Field of the Invention

The present invention relates to connectors for coaxial ribbon cables.

2. Description of the Prior Art

FIGS. 33-35 show a conventional male connector 60 of this type. A cable 50 is held between a pair of cover halves 51 and 52 by a clamp 55 such that the signal lines 54 and the drain lines of the cable 50 engage the signal line engaging grooves 53 and the drain line engaging grooves, respectively. The cover halves 51 and 52 are affixed to an insulation case 58 which has signal terminals 56 and ground terminals 57 so that the signal lines 54 and the drain lines are connected by insulation displacement to the signal terminals 56 and the ground terminals 57, respectively.

The male connector 60 is connected to a female connector 61 which has such a structure as shown in FIGS. 36-37 so that the respective signal terminals and ground terminals are brought into contact with each other.

However, the distance between the signal terminals and the ground terminals is so large that it is impossible to control the impedance. That is, it is impossible to bring the impedance close to that of the cable so that the reflection is too high to transmit high-speed signals. In addition, the front end of each terminal is bent upwardly so that the transmission path is too long to reduce the impedance mismatching. Furthermore, there is no shield between the signal terminals so that there is crosstalk between the signal terminals, interfering the transmission of high-speed signals.

SUMMARY OF THE INVENTION

Accordingly, it is an object of the invention to provide a connector for a coaxial ribbon cable with which it is possible to bring the impedance close to that of the cable.

It is another object of the invention to provide a connector for a coaxial ribbon cable having a transmission path sufficiently short to reduce the impedance mismatching.

It is still another object of the invention to provide a connector for a coaxial ribbon cable which has little or no crosstalk between signal terminals.

It is yet another object of the invention to provide a connector for a coaxial ribbon cable which has low ground inductance and thus low ground noise.

According to one aspect of the invention there is provided a connector for coaxial ribbon cable, which consists of a male connector and a female connector, the male connector including an insulation case with a partition wall; a plurality of signal terminals mounted on one side of the partition wall of the insulation case for connection with a plurality of signal lines of a coaxial cable; a plurality of ground terminals mounted on the other side of the partition wall for connection with a plurality of drain lines of the coaxial cable to form microstrip lines together with the signal terminals; the female connector including a second insulation case with a second partition wall; a plurality of second signal terminals mounted on one side of the second partition wall for contact with the first signal terminals; a plurality of second ground terminals for contact with the second ground terminals mounted on the other side of the second partition wall and form second microstrip lines together with the second signal terminals; the first and second microstrip lines being made substantially equal; and each of the terminals having a spring portion.

By making microstrip lines of the signal terminals and the ground terminals, it is possible to bring the impedance close to that of a coaxial ribbon cable. In addition, each terminal is made in the form of a leaf spring so that it is possible to shorten the transmission path when the male connector is plugged in the female connector, thus reducing the impedance mismatching.

According to another embodiment of the invention there is provided a connector wherein the male connector further including a plurality of shield terminals provided between the signal terminals such that they are brought into contact with the first ground terminals which are connected to a ground of a board through the shield terminals of the female connector.

The shield terminals prevent crosstalk between the signal terminals. By bring the shield terminals into contact with ground terminals in the cable connection area, it is possible to reduce the ground inductance, thus reducing the ground noise.

The above and other objects, features, and advantages of the invention will be more apparent from the following description when taken in conjunction with the accompanying drawings.

DESCRIPTION OF THE PREFERRED EMBODIMENT

Figure 1:
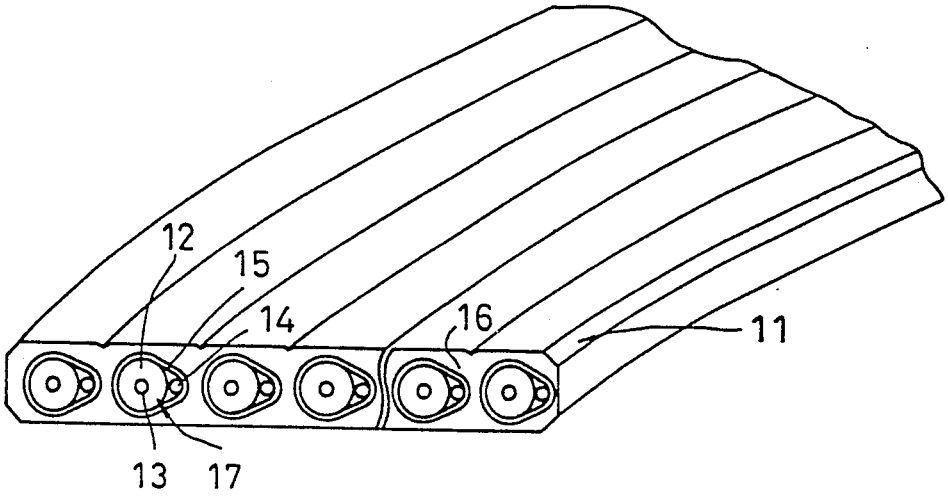
FIG. 1 is a perspective view of a coaxial ribbon cable to be connected to a printed circuit board, for example, by an electrical connector according to the invention.

In FIG. 1, a coaxial ribbon cable 11 includes a number of shielded conductors arranged side by side within an insulation jacket 16. Each shielded conductor has a signal line 17 which consists of a central conductor 13 and a dielectric body 12 coating the central conductor 13, a drain line 14, and a copper foil 15 for wrapping together the signal line 17 and the drain line 14.

Figure 2:
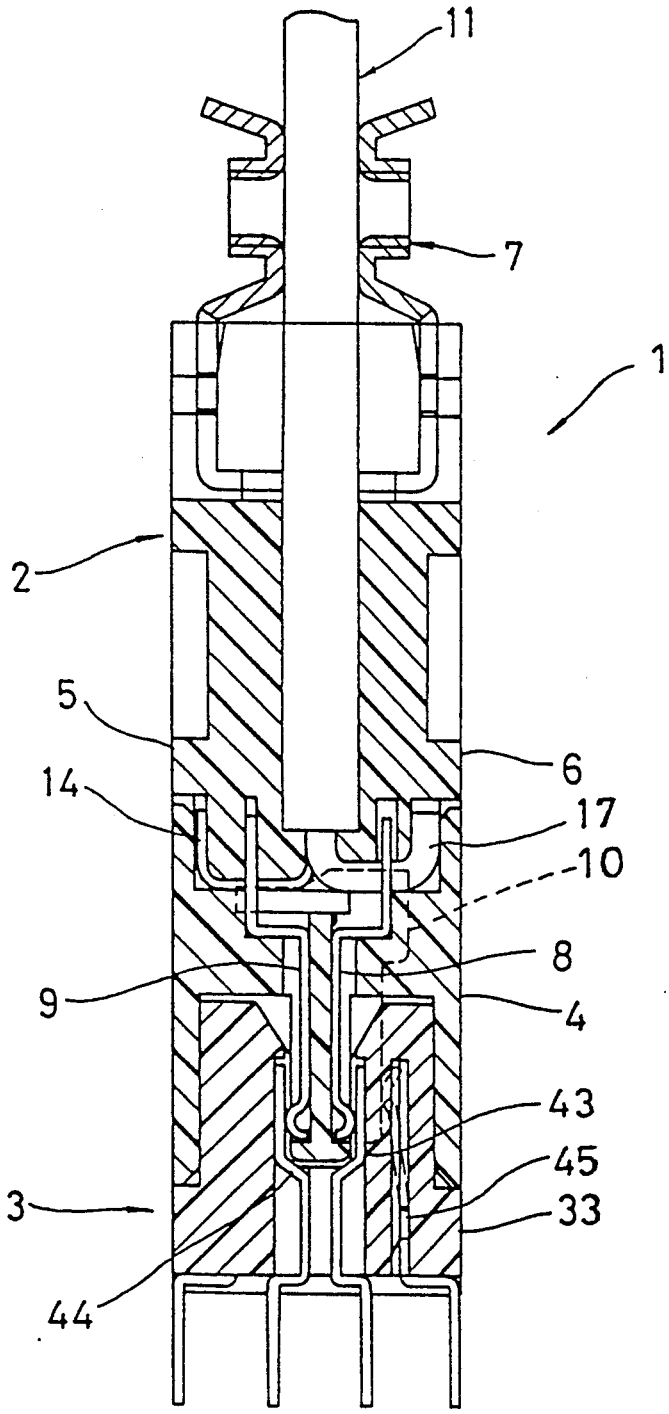
FIG. 2 is a longitudinal section of an electrical connector according to an example of the invention.
Figure 6:
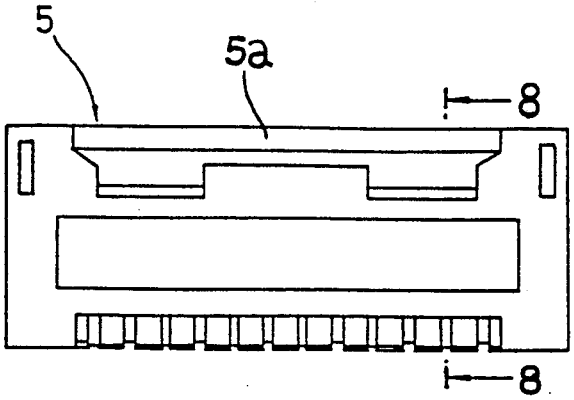
FIG. 6 is a top plan view of a cover half for the male connector.
Figure 8:
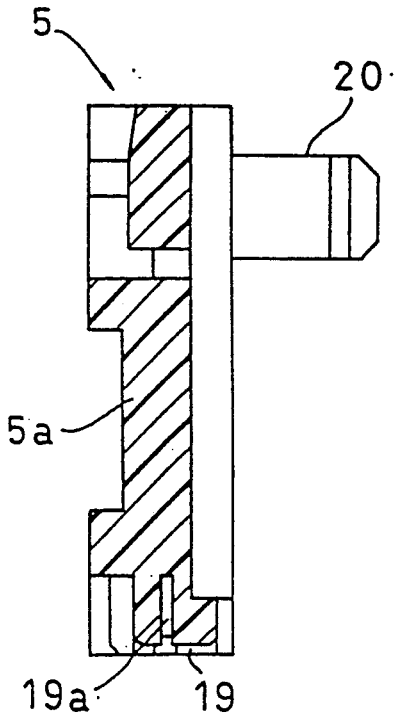
FIG. 8 is a sectional view taken along line 8—8 of FIG. 6.
Figure 7:
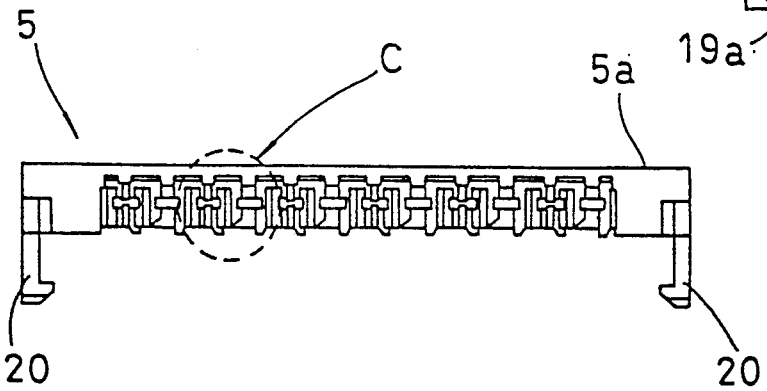
FIG. 7 is a front elevational view of the cover half.
Figure 9:
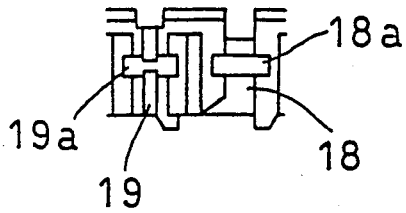
FIG. 9 is an enlarged view of an encircled portion C of FIG. 7.
Figure 10:
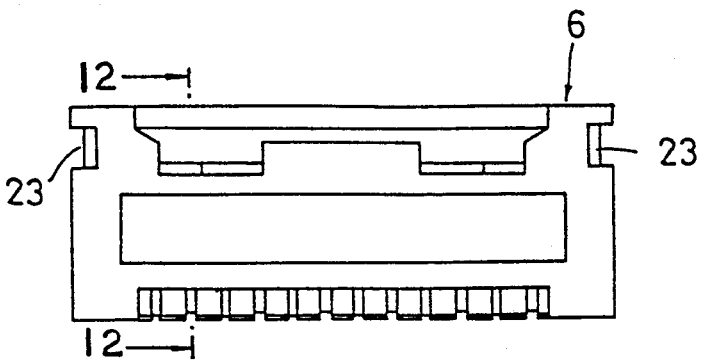
FIG. 10 is a top plan view of the other cover half for the male connector.
Figure 12:
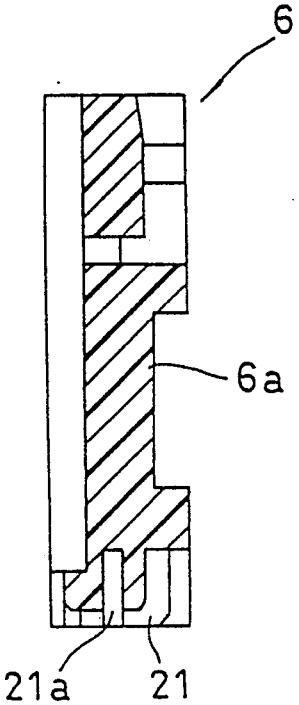
FIG. 12 is a sectional view taken along line 12—12 of FIG. 10.
Figure 11:
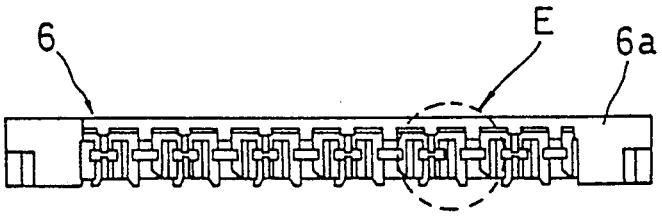
FIG. 11 is a front elevational view of the other cover half.
Figure 13:
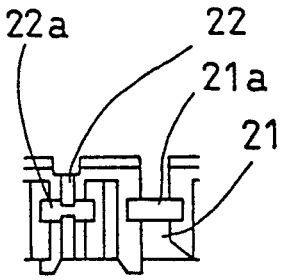
FIG. 13 is an enlarged view of an encircled portion E of FIG. 11.
Figure 14:
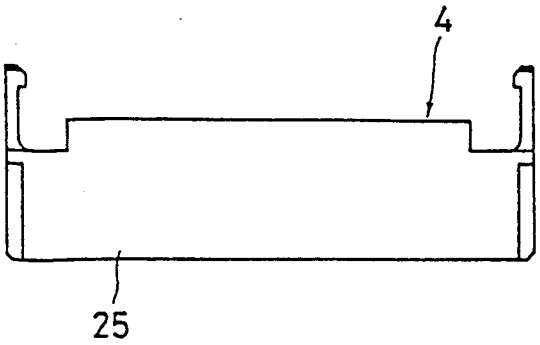
FIG. 14 is a top plan view of an insulation case for the male connector.
Figure 15:
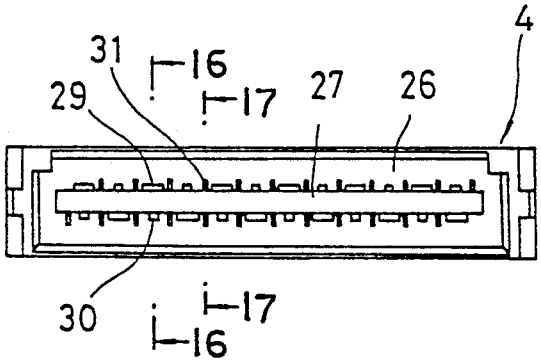
FIG. 15 is a front elevational view of the insulation case.
Figure 16:
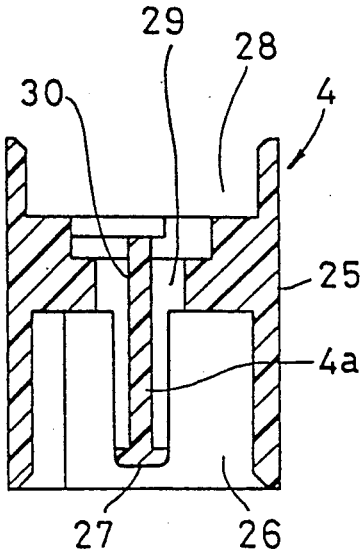
FIG. 16 is a sectional view taken along line 16—16 of FIG. 15.
Figure 17:
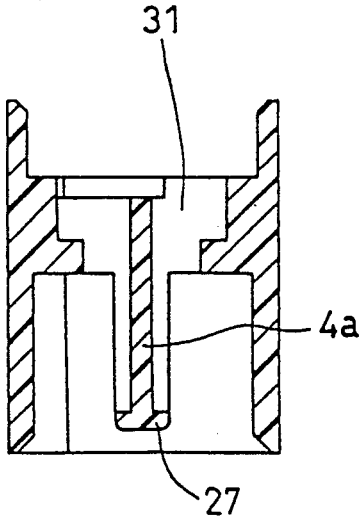
FIG. 17 is a sectional view taken along line 17—17 of FIG. 15.

In FIG. 2, a coaxial ribbon connector 1 consists of a male connector 2 and a female connector 3.

Figure 3:
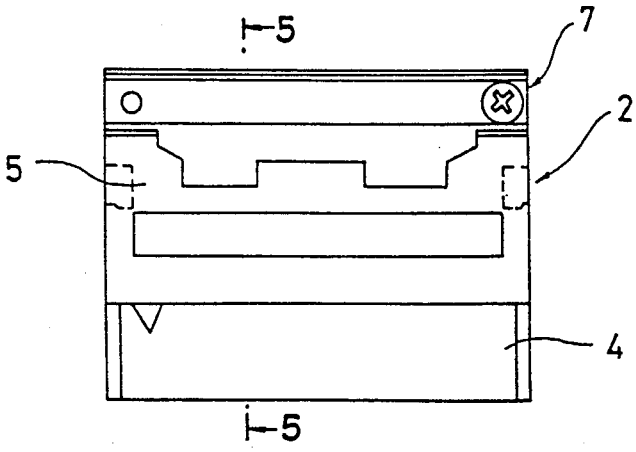
FIG. 3 is a top plan view of a male connector for the electrical connector.
Figure 4:
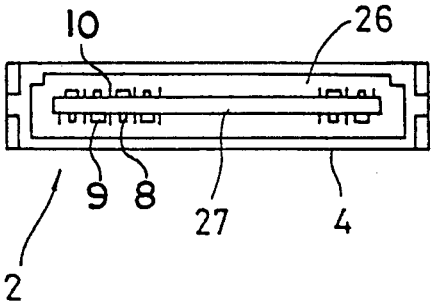
FIG. 4 is a front elevation view of the male connector.
Figure 5:
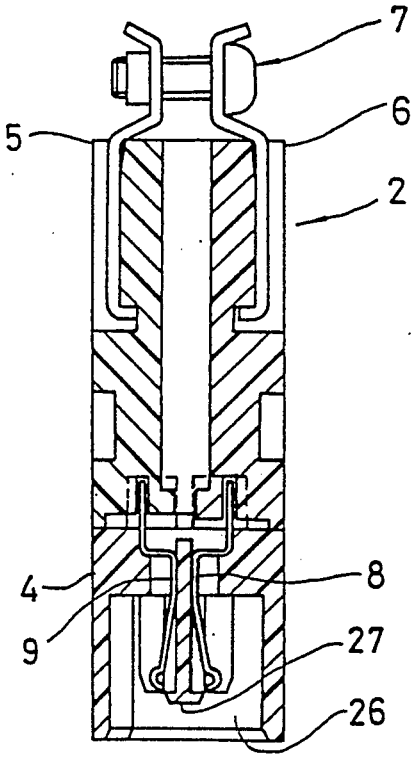
FIG. 5 is a sectional view taken along line 5—5 of FIG. 3.

In FIGS. 3–5, the male connector 2 includes an insulation case 4, a pair of cover halves 5 and 6, a clamp 7, and a number of signal terminals 8, a number of ground terminals 9, and a number of shield terminals 10 (FIG. 2).

In FIGS. 6–9, the cover half 5 has a rectangular cubic cover body 5*a* which is made of a resin. Drain line engaging grooves 19 and signal line engaging grooves 18 alternate on the front face of the cover body 5*a*. The signal line engaging grooves 18 have a terminal slot 18*a* while the drain line engaging grooves 19 have a terminal slot 19*a*. The cover body 5*a* has a pair of latch arms 20 on opposite ends.

Similarly, in FIGS. 10–13, the cover half 6 has a rectangular cubic cover body 6*a* which is made of a resin. Signal line engaging grooves 21 and drain line engaging grooves 22 alternate on the front face of the cover body 6*a*. The signal line engaging grooves 21 have a terminal slot 21*a* while the drain line engaging grooves 22 have a terminal slot 22*a*. The cover body 6*a* has a pair of latch notches 23 on opposite upper corners of the cover body 6*a*.

A length of jacket 16 is removed from the coaxial ribbon cable 11 to expose the copper foil shield 15. The coaxial cable 11 is held between the cover halves 5 and 6 by engaging the latch arms 20 with the latch notches 23 to put together both of the cover halves 5 and 6 so that the signal line engaging grooves 18 and the drain line engaging grooves 19 correspond to the signal line engaging grooves 21 and the drain line engaging grooves 22, respectively. Consequently, the signal line 17 and the drain line 14 are bent along the signal line engaging groove 18 and the drain line engaging groove 22, respectively. The signal line 17 and the drain line 14 of the next shielded conductor are bent along the signal line engaging groove 21 and the drain line engaging groove 19, respectively. Thus, the signal lines 17 and the drain lines 14 alternate along the cover halves 5 and 6 which are put together by the clamp 7.

In FIGS. 14–17, the insulation case 4 has a rectangular cubic case body 25 which is made from a resin. The case body 25 has a fitting cavity 26 on the front face and a terminal support 27 extending forwardly within the fitting cavity 26. The case body 25 has a rectangular recess 28 on the back. Signal terminal mount apertures 29 and ground terminal mount apertures 30 extend downwardly from the bottom of the rectangular recess 28 along the terminal support 27 which extend downwardly from the bottom of the rectangular recess 28 into the fitting cavity 26. A large number of the signal and ground terminal apertures 29 and 30 are formed alternately at predetermined intervals. Shield terminal mount apertures 31 are formed between adjacent sets of the signal terminal mount aperture 29 and the ground terminal mount aperture 30, extending downwardly on the terminal support 27. Signal terminals 8, ground terminals 9, shield terminals 10 are mounted in the respective mount apertures 29, 30, and 31.

Figure 18:
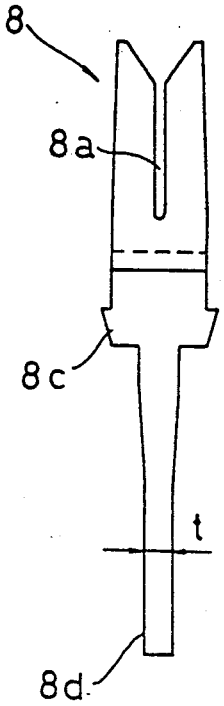
FIG. 18 is a top plan view of a signal terminal for the male connector.
Figure 19:
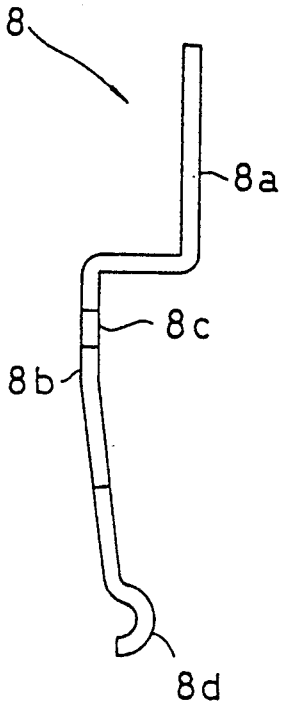
FIG. 19 is a side elevational view of the signal terminal.

In FIGS. 18 and 19, the signal terminal 8 is shaped in the form of a crank to provide an insulation displacement portion 8*a*, a press fit portion 8*c*, and a spring portion 8*b* extending downwardly and outwardly from the press fit portion 8*c* and terminating with an arcked contact portion 8*d*. The press fit portion 8*c* is press fitted into the signal terminal mount aperture 29 to mount the signal terminal 8 such that the insulation displacement portion 8*a* projects upwardly while the spring portion 8*b* extends along the terminal support 27.

Figure 20:
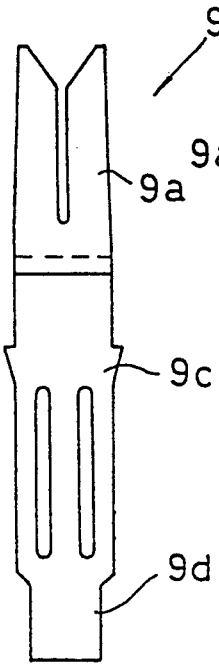
FIG. 20 is a top plan view of a ground terminal for the male connector.
Figure 21:
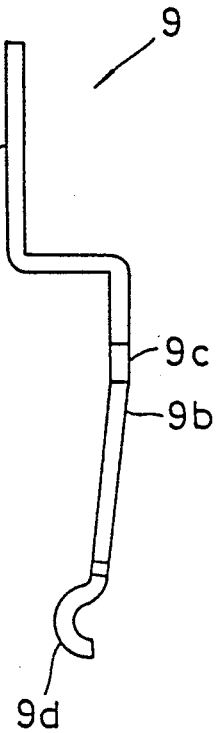
FIG. 21 is a side elevational view of the ground terminal.
Figure 29:
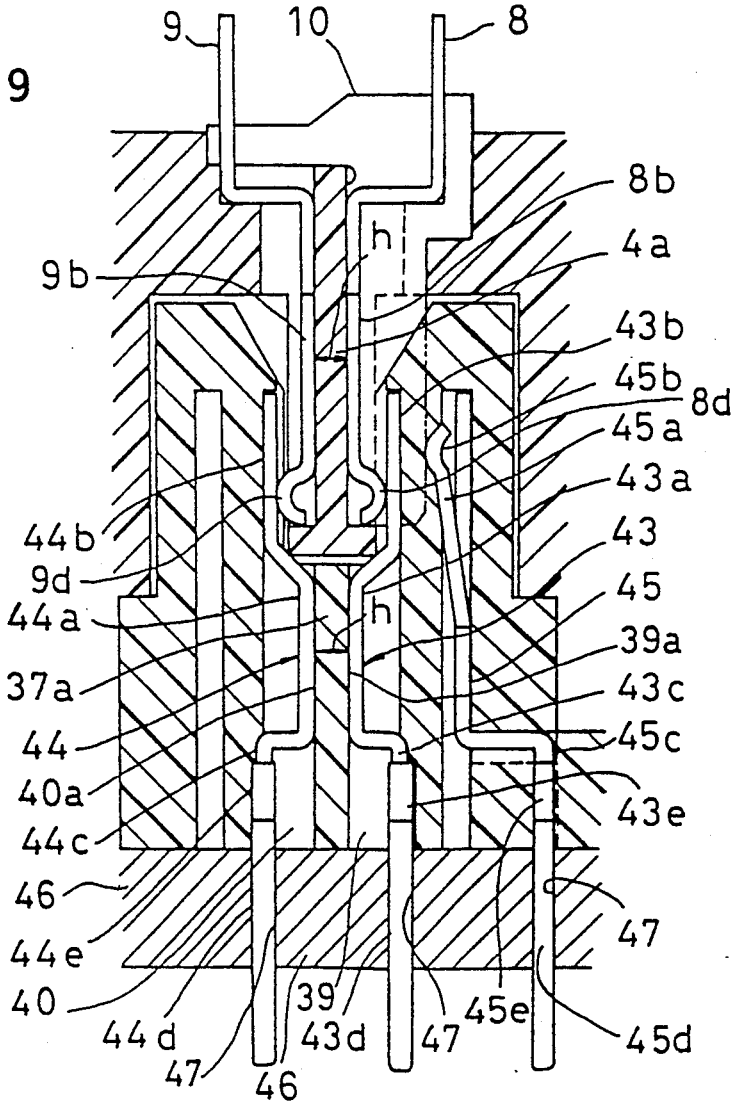
FIG. 29 is a longitudinal section of a female connector plugged into the male connector.

Similarly, in FIGS. 20 and 21, the ground terminal 9 is bent in the form of a crank to provide an insulation displacement portion 9*a*, a press fit portion 9*c*, and a spring portion 9*b* extending downwardly and outwardly from the press fit portion 9*c* and terminating with an arcked contact portion 9*d*. The press fit portion 9*c* is press fitted into the ground terminal mount aperture 30 of the insulation case 4 to mount the ground terminal 9 such that the insulation displacement portion 9*a* projects upwardly while the spring portion 9*b* extends downwardly along the terminal support 27. As shown in FIG. 29, between the spring portions 8*a* and 9*a* of the signal terminal 8 and the ground terminal 9 there is a partition wall 4*a* having a thickness h to form microstrip lines.

Figure 22:
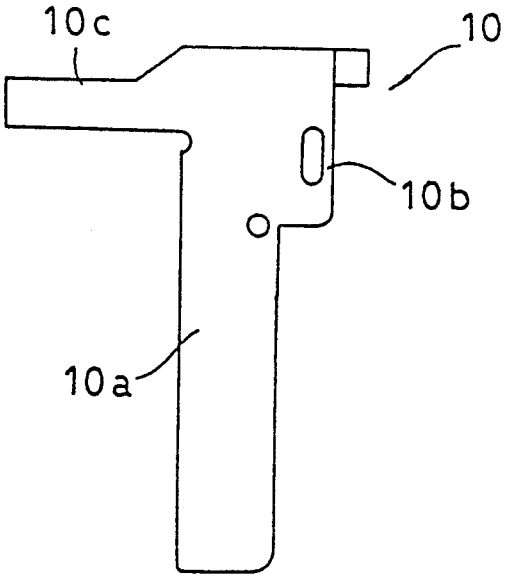
FIG. 22 is a top plan view of a shield terminal for the male connector.
Figure 23:
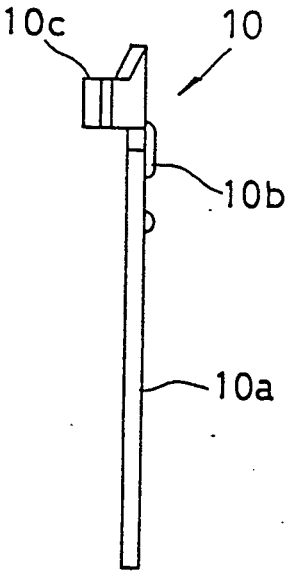
FIG. 23 is a side elevational view of the shield terminal.
Figure 24:
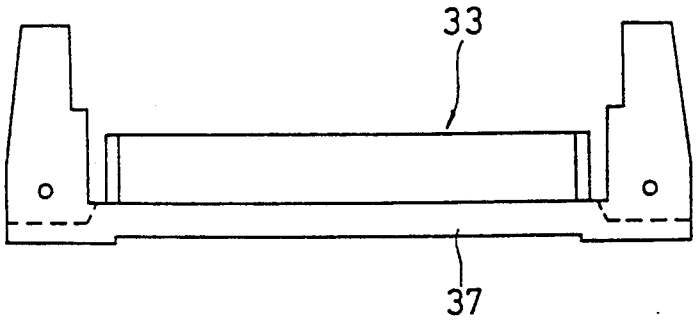
FIG. 24 is a top plan view of a top plan view of a female connector for the electrical connector.
Figure 25:
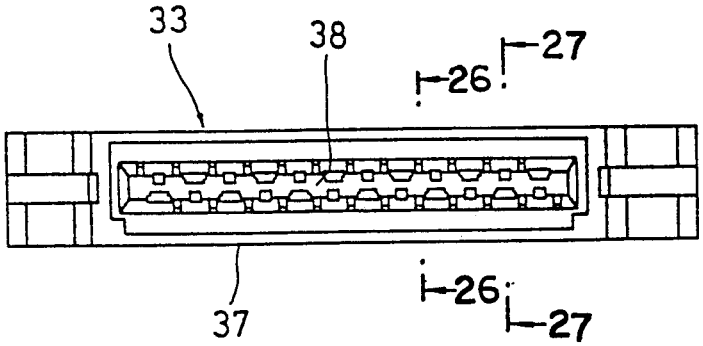
FIG. 25 is a front elevational view of the female connector.
Figure 26:
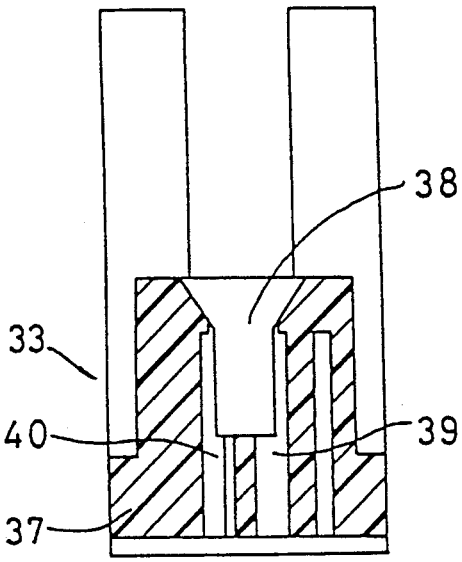
FIG. 26 is a sectional view taken along line 26—26 of FIG. 25.
Figure 27:
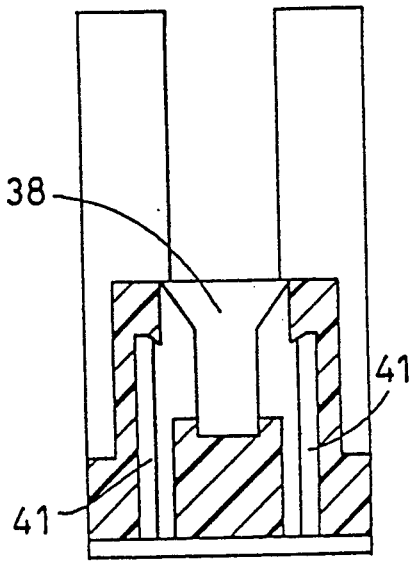
FIG. 27 is a sectional view taken along line 27—27 of FIG. 25.
Figure 28:
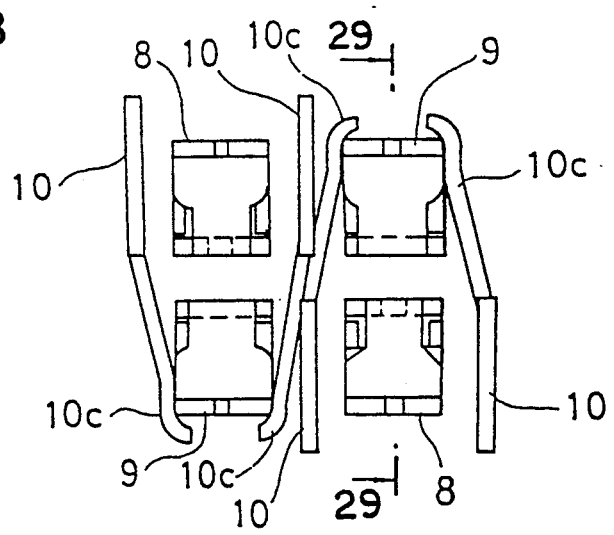
FIG. 28 is a top plan view of respective signal, ground, and shield terminals mounted in the insulation case for the male connector.

In FIGS. 22 and 23, the shield terminal 10 has a flat shield body 10*a* having a press fit portion 10*b* which has a short circuit portion 10*c*. The press fit portion 10*b* is press fitted into the shield terminal mount aperture 31 of the insulation case 4 to mount the shield terminal 10 such that the short circuit portion 10*c* is brought into contact with the ground terminal 9 as shown in FIG. 28. The shield terminals 10 disposed between the adjacent signal terminals 8 prevent crosstalk between the adjacent signal terminals 8.

Referring back to FIG. 2, the front portion of the cover halves 5 and 6 to which a coaxial ribbon cable 11 has been affixed is fitted into the rear recess 26 of the insulation case 4 on which the respective terminals 8, 9, and 10 are mounted so that the signal lines 17 and the drain lines 14 are connected by insulation displacement to the respective insulation displacement portions 8*a* and 9*a* of the signal terminals 8 and the ground terminals 9, thus providing a complete male connector 2. The female connector 3 includes an insulation case 33, a number of signal terminals 43, a number of ground terminals 44, and a number of shield terminals 45.

In FIGS. 24–27, the insulation case 33 of the female connector 3 has a rectangular cubic case body 37 which is made from a resin so as to have a fitting recess 38 on the front face. Signal terminal mount apertures 39 and ground terminal mount apertures 40 extend from the fitting recess 38 to the back face of the case body 37. The signal terminal mount apertures 39 and the ground terminal mount apertures 40 are arranged alternately along the case body 37 at predetermined intervals. Shield terminal mount apertures 41 are formed between the signal terminal mount aperture 39 and the ground terminal mount aperture 40, extending to the back face of the case body 37. The signal terminals 43, the ground terminals 44, and the shield terminals 45 are mounted in the signal terminal mount apertures 39, the ground terminal mount apertures 40, and the shield terminal mount apertures 41, respectively.

As shown in FIG. 29, the signal terminal 43 has a crank like shape, with the upper section 43*a* having a contact portion 43*b* while the lower section 43*c* having a leg portion 43*d* which has a press fit portion 43*e*. The press fit portion 43*e* is press fitted into the signal terminal mount aperture 39 to mount the signal terminal 43. The upper section 43*a* extend upwardly along the side wall 39*a* of the signal terminal mount aperture 39.

Similarly, the ground terminal 44 has a crank like form, with the upper section 44*a* having a contact portion 44*b* and the lower section 44*c* having a leg portion 44*d* which has a press fit portion 44*e*. The press fit portion 44*e* is fitted into the ground terminal mount aperture 40 to mount the ground terminal 44. The upper section 44*a* extends upwardly along the side wall 40*a* of the ground terminal mount aperture 40. The signal terminal 39 and the ground terminal 44 are separated by the partition wall 37*a* having a thickness h to form microstrip lines.

The shield terminal 45 has a crank like form, the upper section having a spring portion 45*a* and a contact portion 45*b* and the lower section having a press fit portion 45*e* and a leg portion 45*d*. The press fit portion 45*e* is press fitted into the shield terminal mount aperture 41 to mount the shield terminal 45. The female connector 3 is mounted on a board 46 by inserting into the through holes 47 and soldering the leg portions 43*d*, 44*d*, and 45*d* of the respective terminals 43, 44, and 45.

When the male connector 2 is inserted into the female connector 3, the contact portions 8*d* of the signal terminals 8 in the male connector 2 are brought into contact with the contact portions 43*b* of the signal terminals 43 in the female connector 3 while the contact portions 9*d* of the ground terminals 9 in the male connector 2 are brought into contact with the contact portions 44*b* of the ground terminals 44 in the female connector 3. Simultaneously, the side edge of the shield terminals 10 of the male connector 2 are brought into contact with the contact portion 45*b* of the shield terminals 45 in the female connector 3.

In the male connector, the straight portion 8*b* of the signal terminal 8 and the straight portion 9*b* of the ground terminal 9 sandwich the partition wall 4*a* of the insulation case 4 to form microstrip lines. Similarly, in the female connector, the straight portions 43*a* and 44*a* of the signal terminal 43 and the ground terminal 44 sandwich the partition wall 37*a* of the insulation case 37 to form microstrip lines. Thus, it is possible to bring the impedance close to that of the coaxial ribbon cable 11.

For example, when the dielectricity, the distance between the signal terminal and the ground terminal, and the thickness of the signal terminal are 3.9, 0.6 mm, and 0.25 mm, respectively, the desired width t of the signal terminal 8 (FIG. 18) and 43 given by Wheeler's formula for the characteristic impedance is 1.07 mm.

The shield terminals 10 provided between adjacent signal terminals 8, with the short circuit portions 10*c* in contact with the ground terminals 9, prevent crosstalk between the signal terminals. In addition, it reduces the ground inductance, resulting in the reduced ground noise level. Each terminal has a spring portion so that upon connection, it is possible to shorten the transmission path, thereby reducing the impedance mismatching.

Figure 30:
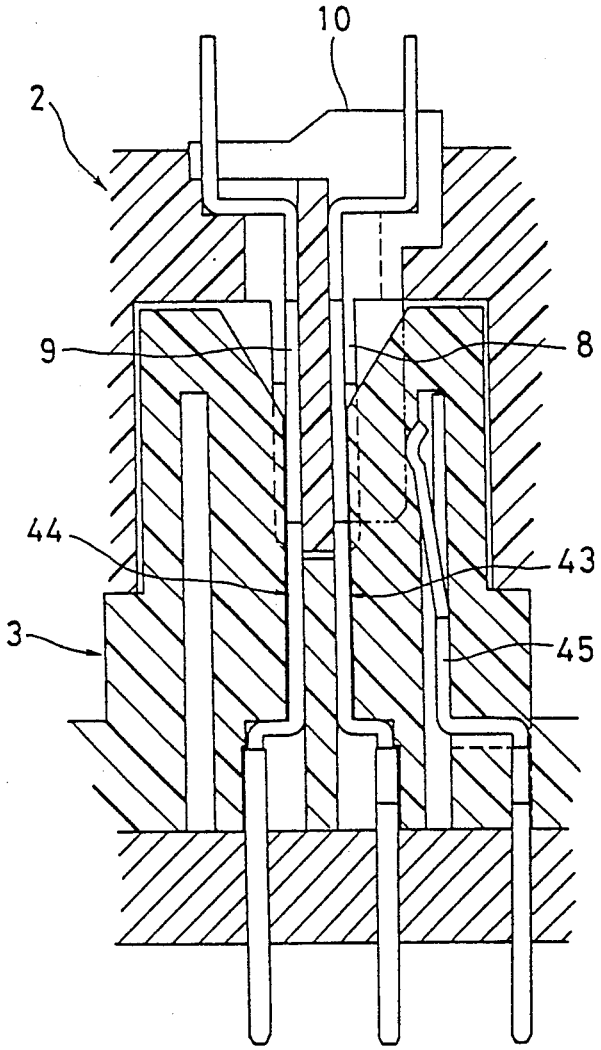
FIG. 30 is a side elevational view of a signal terminal and a ground terminal of the male connector and a signal terminal and a ground terminal of the female connector connected to the corresponding male terminals according to another embodiment of the invention.
Figure 31:
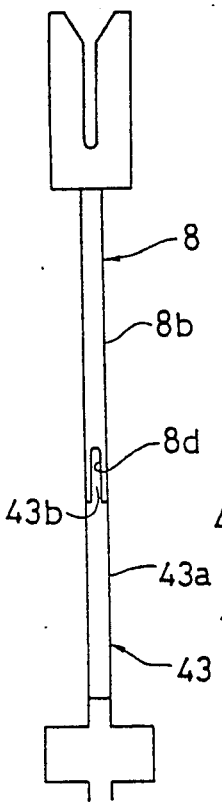
FIG. 31 is a top plan view of the signal terminals.
Figure 32:
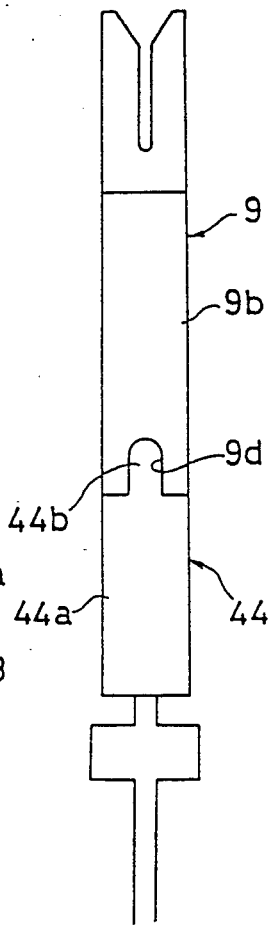
FIG. 32 is a top plan view of the ground terminals.
Figure 33:
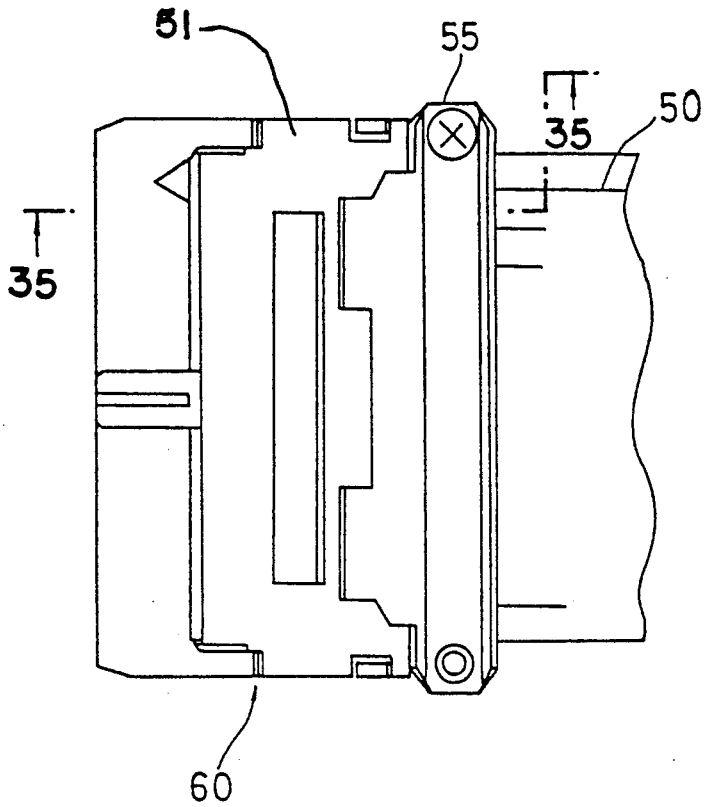
FIG. 33 PRIOR ART
FIG. 33 is a top plan view of a conventional male connector.
Figure 34:
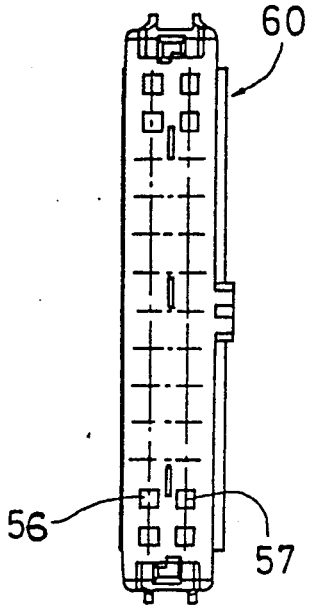
FIG. 34 PRIOR ART
FIG. 34 is a front elevational view of the male connector.
Figure 35:
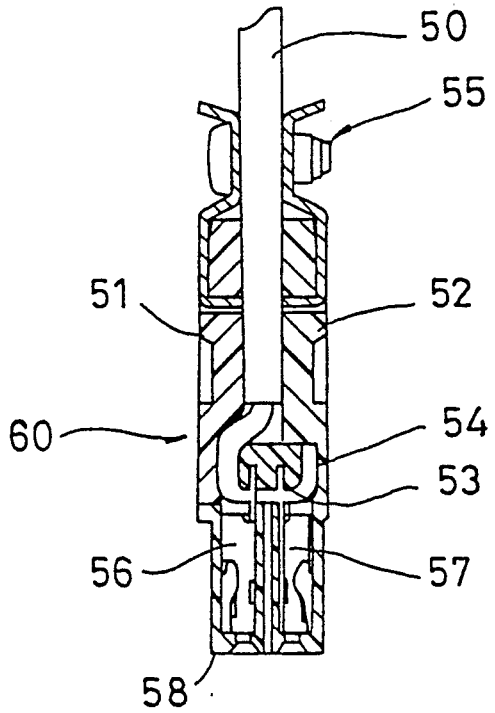
FIG. 35 PRIOR ART
FIG. 35 is a sectional view taken along line 35—35 of FIG. 33.
Figure 36:
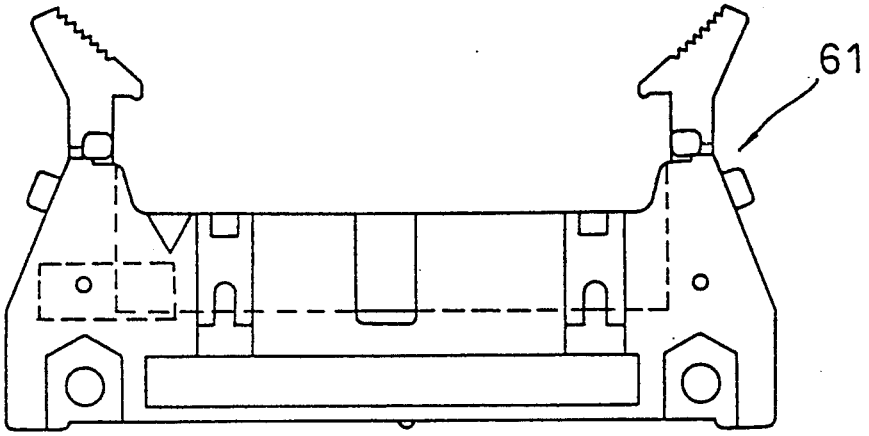
FIG. 36 PRIOR ART
FIG. 36 is a top plan view of a conventional female connector.
Figure 37:
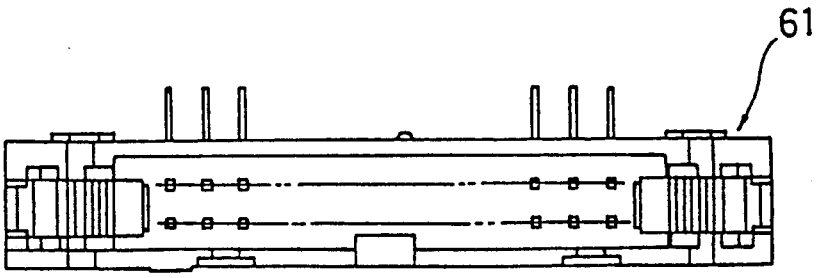
FIG. 37 PRIOR ART
FIG. 37 is a front elevational view of the female connector.

Alternatively, as FIGS. 30–32 show, a U-shaped contact notch 8*d* is formed on the front end of the straight portion 8*b* of the signal terminal 8 while a U-shaped contact portion 43*b* is formed on the front end of the straight portion of the signal terminal 43. The contact portion 43*b* is fitted into the contact portion 8*d* for establishing a connection. Similarly, a U-shaped contact notch 9*d* is formed on the front end of the straight portion 9*b* of the ground terminal 9 while a U-shaped contact projection 44*b* is formed on the front end of the straight portion 44*a* of the ground terminal 44 such that the contact projection 44 fits in the contact notch 9*d*.

We claim:

1. A connector for a coaxial ribbon cable, which consists of a male connector and a female connector, said male connector comprising:

an insulation case with a partition wall;

a plurality of signal terminals mounted on one side of said partition wall of said insulation case for connection with a plurality of signal lines of a coaxial ribbon cable;

a plurality of ground terminals mounted on the other side of said partition wall for connection with a plurality of drain lines of said coaxial ribbon cable to form microstrip lines together with said signal terminals;

said female connector comprising:

a second insulation case with a second partition wall;

a plurality of second signal terminals mounted on one side of said second partition wall for contact with said first signal terminals;

a plurality of second ground terminals for contact with said second ground terminals on the other side of said second partition wall and form second microstrip lines together with said second signal terminals, thereby providing an impedance match, wherein said male connector further comprises a plurality of shield terminals provided between the signal terminals such that they are brought into contact with said first ground terminals; and said female connector further comprises a plurality of second shield terminals provided between said second signal terminals which are connected to a ground of a board and brought into contact with said shield terminals so that said shield terminals are grounded through said second shield terminals of said female connector thereby not only preventing cross-talk but also reducing noise.

2. The connector of claim 1, wherein said first and second microstrip lines being made substantially equal.

3. The connector of claim 1, wherein the width of said signal terminals is 1.07 mm, thereby providing a precise impedance match.

* * * * *